US009802168B2

(12) United States Patent
Holly et al.

(10) Patent No.: US 9,802,168 B2
(45) Date of Patent: Oct. 31, 2017

(54) JAR WITH INTEGRATED STIRRING DEVICE

(71) Applicants: Paul Holly, Chicago, IL (US); Veronica Stout-Holly, Chicago, IL (US)

(72) Inventors: Paul Holly, Chicago, IL (US); Veronica Stout-Holly, Chicago, IL (US)

( * ) Notice: Subject to any disclaimer, the term of this patent is extended or adjusted under 35 U.S.C. 154(b) by 362 days.

(21) Appl. No.: 14/489,916

(22) Filed: Sep. 18, 2014

(65) Prior Publication Data

US 2015/0103622 A1 Apr. 16, 2015

Related U.S. Application Data

(60) Provisional application No. 61/890,220, filed on Oct. 12, 2013.

(51) Int. Cl.

| | |
|---|---|
| ***B01F 7/00*** | (2006.01) |
| ***B01F 11/00*** | (2006.01) |
| ***B01F 13/00*** | (2006.01) |
| ***B01F 15/00*** | (2006.01) |

(52) U.S. Cl.

CPC ..... *B01F 7/00058* (2013.01); *B01F 11/0054* (2013.01); *B01F 13/0022* (2013.01); *B01F 15/00006* (2013.01); *B01F 15/00506* (2013.01); *B01F 2215/0014* (2013.01)

(58) Field of Classification Search

CPC ..... B01F 7/00183; B01F 7/00058; B01F 11/0054; B01F 13/0022; B01F 15/00506; B01F 15/00006

USPC ..... 366/247, 130

See application file for complete search history.

(56) References Cited

U.S. PATENT DOCUMENTS

2010/0260005 A1* 10/2010 Bodum ..... A47J 43/0465 366/144

2015/0366406 A1* 12/2015 Hilscher ..... A47J 43/27 366/130

* cited by examiner

*Primary Examiner* — Charles Cooley
*Assistant Examiner* — Marc C Howell

(57) ABSTRACT

A jar or other storage container with an integrated stirring device, where the contents of the jar or storage container can be stirred and mixed together without having to completely open the jar or storage container. The core components in one embodiment are a top portion that contains external threads, a lid portion which contains internal threads, a spindle with an etched self-reversing screw pattern, a hub, one or more stirring blades, and a nut. The stirring blades have one end attached at a hub that is free to rotate on the spindle, the other end is attached to a nut that can travel up and down the self-reversing screw pattern, and the spindle is fixed to the lid portion. The surface area of the stirring blade(s) can be changed to accommodate different thicknesses and viscosities of different fluids and semi-fluids placed in the storage container.

8 Claims, 3 Drawing Sheets

JAR WITH INTEGRATED STIRRING DEVICE

CROSS-REFERENCE TO RELATED APPLICATION

This application claims the benefit of U.S. Provisional Application No. 61/890,220, filed Oct. 12, 2013.

BACKGROUND

This application relates to jars, such as food jars, or other storage containers that may use lids that are screwed on via threaded connections. Such jars and storage containers are often used for long term storage and to keep air from entering the container.

Long term storage of liquid or semi-liquid contents can result in the separation of component parts of the contained matter. For example, 'natural peanut butter' can have some of the oil contained inside of it separate out and form an oil layer near the top of the jar or storage container. Once the container is opened, it is then necessary to stir and mix the contents in order to homogenize the food or other product. Since such containers are usually full of the substance or product, it can often be difficult and messy to attempt to do the stirring or mixing inside the container once the lid has been removed. Options are unsatisfactory and include creating a mess or transferring the entire contents of the jar or storage container in order to mix the contents.

It would be desirable to have a jar or storage container that addressed the issues above.

SUMMARY OF THE INVENTION

This application relates to an apparatus that provides the ability to stir and/or mix the contents of a jar or storage container without the necessity of removing the lid. The application also relates to a method of stirring and/or mixing the contents of a jar or storage container without the necessity of removing the lid.

It is an objective of an embodiment of the invention to provide a lid with an attached stirring or mixing mechanism on a spindle that is contained within the jar or storage mechanism when the lid is on. The lid may be removable and re-attachable to a jar or storage container by means of a typical mechanism of using threads on both the lid and the jar and storage mechanism.

It is another objective of an embodiment of the invention for the lid to provide a means for the lid to rotate freely without requiring the removal of the lid or opening of the jar or storage container. This causes the entire stirring or mixing mechanism to rotate inside the jar or storage container. The free rotation may be accomplished by providing an area below where the threads of the lid can fit after they have passed through the threads of the jar or storage container. Upon reversal of the spinning of the lid, the threads may catch again, and the lid starts unscrewing upwards.

It is another objective of an embodiment of the invention for the rotation of the stirring mechanism to maybe cause a nut to move up and down a self-reversing thread pattern etched into the spindle thereby causing one or more stirring blades to bend and widen inside the jar or storage container. The rotation and bending of the stirring blades may cause the contents of the jar or storage container to begin mixing. The drag of the contents of the jar or storage container may provide the leverage for the nut to ascend and descend the self-reversing thread pattern on the spindle.

It is another objective of an embodiment of the invention to maybe provide additional stirring blades attached to the stirring mechanism, wider stirring blades, additional propeller-like structures attached to the stirring mechanism, or other means to increase the surface area of the stirring blades in order to create more drag on the contents of the jar in order to work with less dense or viscous fluids or less dense or viscous semi-fluids.

In one embodiment, the invention comprises a jar or storage container with a corresponding lid. The lid has a rigidly attached spindle. When the lid is screwed on to the jar or storage container the spindle extends inside of the jar or storage container. When the lid is on the storage container such that a seal is formed, the spindle does not extend outside the jar or storage container. Internal threads on the lid are only on the lower portion of the lid. Corresponding external threads on the jar or storage container are only on the upper portion such that continuing to screw the lid on to the jar or storage container ends up having the threads on the lid be underneath the threads on the jar or storage container. At this point the lid is free to continue to rotate while still substantially sealing the contents of the jar or storage container. The spindle is rotating inside the jar or storage container to mix the contents. The top of the jar or storage container may be brushing the inside surface of the top portion of the lid at this point preventing the lid from descending further. Reversing the rotation of the lid may allow the threads to catch again enabling the unscrewing of the lid from the jar or storage container.

The embodiment may further have a self-reversing screw pattern etched on to the spindle. There are various self-reversing screw patterns known in the art that can be used by those skilled in the art along with a corresponding nut for a corresponding screw pattern. A stirring blade may be included with the embodiment where one end of the stirring blade is attached to a hub that is attached to the spindle but free to rotate around the axis of the spindle. The second end of the stirring blade may be attached to the nut. The nut is free to travel up and down the self-reversing screw pattern. The nature of the screw pattern is such that when the nut reaches one end of the pattern or the other it reverses direction and starts traveling the opposite direction. The back-pressure of the contents of the jar or storage container provides the force to cause the nut to travel up and down the self-reversing screw pattern. The bending of the stirring blade along with the nut moving up and down the screw pattern may further and more effectively mix the contents of the jar or storage container.

The embodiment may further have a propeller-like blade that is attached to the stirring blade. This may increase the amount of back-pressure caused by the rotation of the lid as the propeller-like blade moves through the contents of the jar or storage container.

Another embodiment may consist of a spindle attached to the underside of a lid with the spindle extending into a jar or storage container to mix the contents. At least a portion of the spindle has etched into it a self-reversing screw pattern. A nut is free to travel up and down the etched self-reversing screw pattern where once it reaches one end of the pattern or another it reverses direction. A hub is attached to the spindle such that the hub is free to spin around the axis of the spindle at its attached location. At least one stirring blade is attached such that one end of the stirring blade is attached to the hub and the other to the nut. Back-pressure on the blade caused by the contents of the storage container while the lid is being spun causes the nut to travel up and down the self-reversing screw pattern.

BRIEF DESCRIPTION OF THE DRAWINGS

The present disclosure will be more fully understood by reference to the following detailed description of one or more preferred embodiments when read in conjunction with the accompanying drawings, in which like reference characters refer to like parts throughout the views and in which.

DETAILED DESCRIPTION OF THE ILLUSTRATED EMBODIMENT(S)

Figure 1:
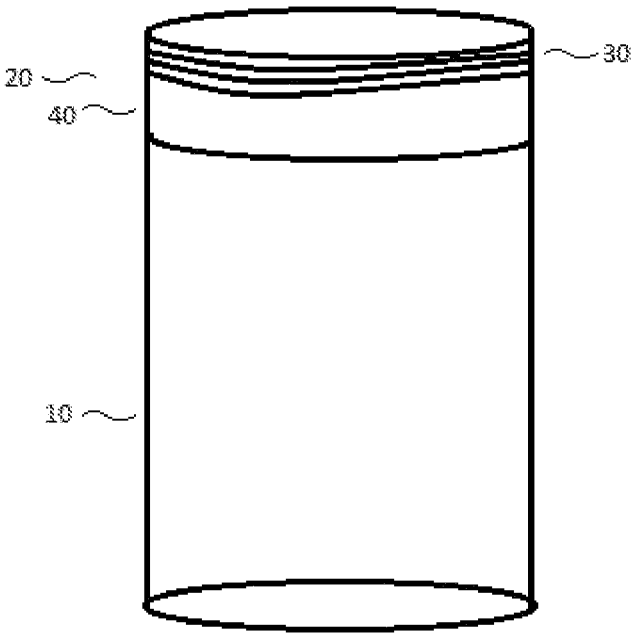
FIG. 1 is a front view of the jar or storage portion of an embodiment of the device.
Figure 2:
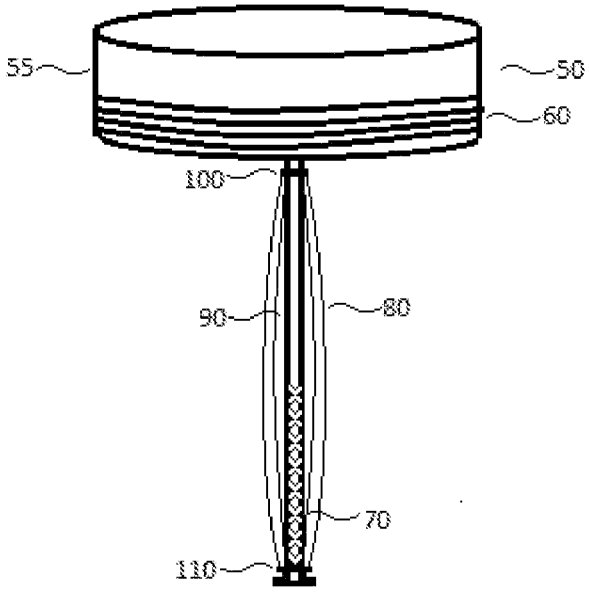
FIG. 2 is a front view of the lid of the embodiment with an attached stirring mechanism with the stirring portions in the down or starting position.

Turning to the figures, FIG. 1 shows the jar or storage container portion of one embodiment that is made of the following components: a lower portion 10 consisting of the main storage portion of the container, an upper portion 20 which mates with the lid shown in FIG. 2. The upper portion 20 consists of an upper threaded portion 30 and a lower non-threaded portion 40. The threads are on the outside of the upper portion 30. The jar or storage container can be made of glass, plastic, or other material that is known in the art.

FIG. 2 shows the lid portion that matches the jar or storage container shown in FIG. 1. The lid portion consists of the following components: an upper portion 50 that has the top non-threaded portion 55 and a bottom threaded portion 60, a central spindle portion 90 with a self-reversing screw pattern 70 etched into the lower half, one or more flexible stirring blades 80 [shown with two], a hub 100 that allows the flexible stirring blade 80 to rotate around the top of the spindle portion 90, and a nut 110 that travels along the screw pattern 70 etched into the spindle 90. The threads on the threaded portion 60 are located on the inside of the upper portion of the lid. The stirring blades, lid and/or spindle can be made of metal, plastic, or other materials that are known in the art.

These components are connected as follows: the top of spindle 90 is rigidly attached to the upper portion 50 in the bottom center of the inside lid portion, the hub 100 is affixed to an upper portion of spindle 90 allowing it to spin freely but not move up and down the spindle 90, the one or more stirring blades 80 have one end attached to the hub 100 allowing it to spin along with the hub 100 while the other end of the one or more stirring blades 80 have the other end attached to the nut 110, and the nut 110 is attached only to the one or more stirring blades 80 but are able to move up and down the self-reversing screw pattern etched into spindle 90. The nut 110 is configured in a manner as is apparent to those skilled in the art to move up and down the self-reversing screw pattern. Various self-reversing screw patterns with corresponding nuts are known to those skilled in the art and can be used.

Figure 3:
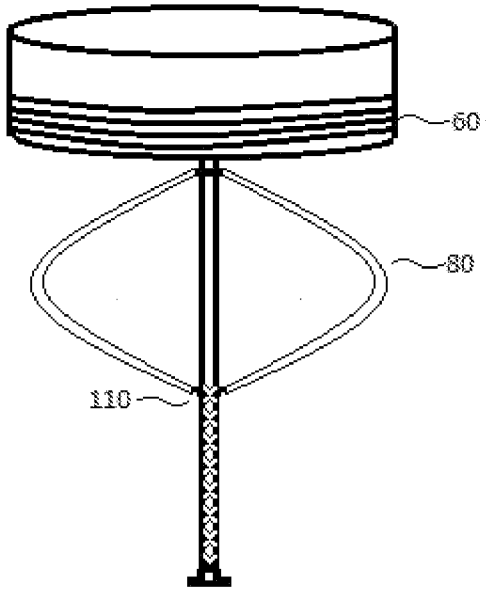
FIG. 3 is a front view of the lid of the embodiment with an attached stirring mechanism with the stirring portions in the up position.
Figure 5:
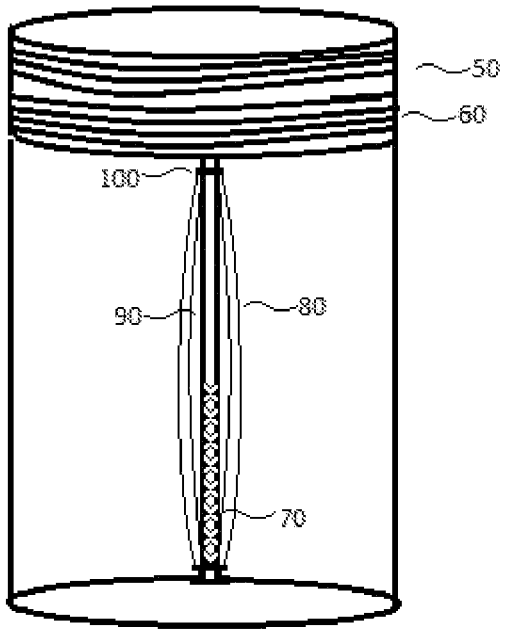
FIG. 5 is a front view with the lid of the first embodiment fully screwed on to the jar or storage portion so that the threads of the lid are below the threads of the jar or storage portion allowing free rotation of the lid against the jar or storage portion.

FIG. 3 shows the lid portion of the jar after the nut 110 has traveled up to the top of the self-reversing screw pattern 70. The motion of the nut 110 can be caused while the lid portion is contained inside of the jar or storage portion. FIG. 5 shows the lid portion inside of the jar or storage container. The thread patterns in the lid portion 60 allow it to be screwed into the jar or storage portion thread patterns 60, but if the screwing motion is continued until thread patterns 60 are beneath thread patterns 30 then the lid portion of the jar is now free to rotate freely without descending any further. With a fluid or semi-fluid inside the storage container, the backpressure on the stirring blade 80 causes the nut to travel up and down the self-reversing thread pattern 70. Reversal of the screwing motion can occur with the thread patterns 30 re-engaging with the storage portion thread patterns 60 allowing for un-screwing of the lid portion and removal.

Figure 4:
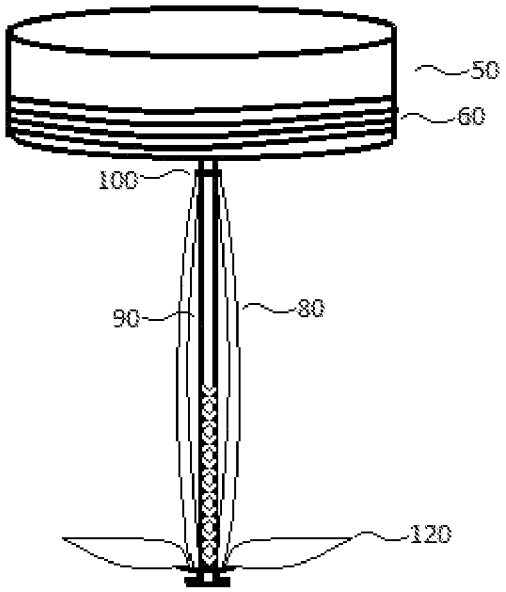
FIG. 4 is a front view of the lid of another embodiment with an attached stirring mechanism with the stirring portions in the down or starting position with additional surface area added to the stirring mechanism to provide more drag in whatever is contained in the jar or storage portion.

FIG. 4 shows another embodiment of the lid portion of the jar with the addition of one or more propeller-like structures 120 in order to increase the back-pressure of the fluid or semi-fluid contained in the storage container if desired. This jar with integrated stirring device is not limited to these embodiments but also includes other embodiments where the surface area of the stirring blades is increased in order to create more back-pressure from the fluid or semi-fluid contained in the storage container.

FIG. 5 shows the lid portion fully inserted into the jar or storage portion with the thread pattern 60 located below the thread pattern 30 allowing the lid portion to freely rotate inside of the jar or storage portion.

In another version of the invention, the self-reversing thread pattern 70 continues higher on to the spindle 90 potentially until it reaches the hub 100. (Not shown in any figure).

In yet another version of the invention, there are two separate self-reversing thread patterns 70 and the hub 100 is replaced by another nut 110. This allows both ends of the stirring blades 80 to move up and down the spindle 90. (Not shown in any figure).

In yet another version of the invention, there are two or more separate sets of stirring blades 80, each with their own respective hubs 100 and nuts 110 with their respective nuts following their own respective self-reversing thread patterns 70. (Not shown in any figure).

The foregoing description of various embodiments and versions of the invention has been presented for purposes of illustration and description, and is not intended to be exhaustive or to limit the invention to the precise forms disclosed. The descriptions were selected to best explain the principles of the invention and practical application of these principals to enable others skilled in the art to best utilize the invention in various embodiments and various modifications as are suited to the particular use contemplated. It is intended that the scope of the invention not be limited by the specification, but be defined by the claims set forth below.

What is claimed is:

1. A container with stirring mechanism comprising:

a spindle attached to the underside of a lid extending into the container wherein a portion of the spindle has an etched self-reversing screw pattern;

a nut free to travel up and down said etched self-reversing screw pattern;

a hub attached to said spindle wherein the hub is free to spin around said spindle at its attached location; and a first stirring blade with a first end and a second end wherein the first end of the first stirring blade is attached to the hub and the second end of the first stirring blade is attached to the nut.

2. The container of claim 1 wherein the nut ravels up and down the self-reversing screw pattern when back-pressure is created by the contents of the container when said spindle is rotated.

3. The container of claim 2 further comprising first threads on the lid and corresponding second threads on the container.

4. The container of claim 3 wherein rotating the lid in a first direction moves the first threads along the second threads until the first threads are below the second threads and said lid is free to rotate indefinitely once said first threads have completely moved through said second threads.

5. The container of claim 4 wherein rotating the lid in a direction opposite said first direction once said first threads are below said second threads causes first threads to re-engage second threads to enable the lid to move up along said second threads.

6. A method of mixing the contents of a storage container comprising: providing the container with stirring mechanism of claim 1, and rotating the lid with attached spindle, wherein said rotating the lid creates backpressure to the first stirring blade with the first end attached to the hub free to spin around said spindle at the attached point and the second end attached to the nut free to travel up and down the self-reversing screw pattern etched into said spindle.

7. The method of mixing the contents of a storage container according to claim 6, further comprising rotating said lid until a first set of threads on said lid has traveled through a second set of threads on said container allowing the lid to continue to spin freely once the end of the second set of threads is reached.

8. The method of mixing the contents of a storage container according to claim 7, further comprising rotating said lid in a reverse direction until the first set of threads on said lid catches the second set of threads on the lid and continuing the reverse rotation of the lid until the first set of threads disengages from the second set of threads enabling disengagement of said lid from said storage container.

* * * * *